United States Patent [19]

Ito et al.

[11] 4,126,983

[45] Nov. 28, 1978

[54] BINDING TAPE DEALING APPARATUS FOR PAPER BUNDLE BINDING APPARATUS

[75] Inventors: Yukio Ito, Fujisawa; Susumu Morishima, Kamakura, both of Japan

[73] Assignees: Hitachi Denshi Engineering Kabushiki Kaisha, Kanagawa; Musashi Kabushiki Kaisha, Tokyo, both of Japan

[21] Appl. No.: 789,279

[22] Filed: Apr. 20, 1977

[30] Foreign Application Priority Data

Apr. 27, 1976 [JP] Japan ..... 51-47209

[51] Int. Cl.[2] ..... B65B 13/04; B65B 27/08

[52] U.S. Cl. ..... 53/593; 53/529; 100/27

[58] Field of Search ..... 53/124 C, 198 R, 199, 53/210, 218; 100/27, 28; 83/586

[56] References Cited

U.S. PATENT DOCUMENTS

| | | | |
|---|---|---|---|
| 1,505,028 | 8/1924 | Karlson | 83/586 X |
| 1,671,376 | 5/1928 | Parker | 100/27 |
| 2,837,884 | 6/1958 | Gibbons | 53/198 R |
| 2,972,844 | 2/1961 | Ripley | 53/198 R |
| 3,309,839 | 3/1967 | Lyon | 53/198 R |
| 3,955,340 | 5/1976 | Tomita et al. | 53/199 |
| 4,014,731 | 3/1977 | Muto | 100/17 |

*Primary Examiner*—John Sipos

*Attorney, Agent, or Firm*—Wenderoth, Lind & Ponack

[57] ABSTRACT

Disclosed in a binding tape dispensing and dealing mechanism for an apparatus for binding a bundle of paper sheets such as paper money with the binding tape, which mechanism comprises a ring-like or annular flyer provided with tape guide rollers for holding and guiding the binding tape therebetween. The annular flyer is adapted to be rotated about a bundle of the stacked papers disposed substantially at a center portion of the flyer ring, to thereby wind the binder tape about the paper bundle as the flyer ring is revolved about the center thereof. The tape dealing mechanism further includes a cutter for cutting the tape in a predetermined length, a pressing lever for pressing the cut end portion of the binder tape wound around the bundle of stacked papers against a lateral side of the paper stack, a spring and cam for controlling the operation of the cutter, and another spring and cam for controlling the movement of the pressing lever relative to the lateral side of the paper stack.

5 Claims, 6 Drawing Figures

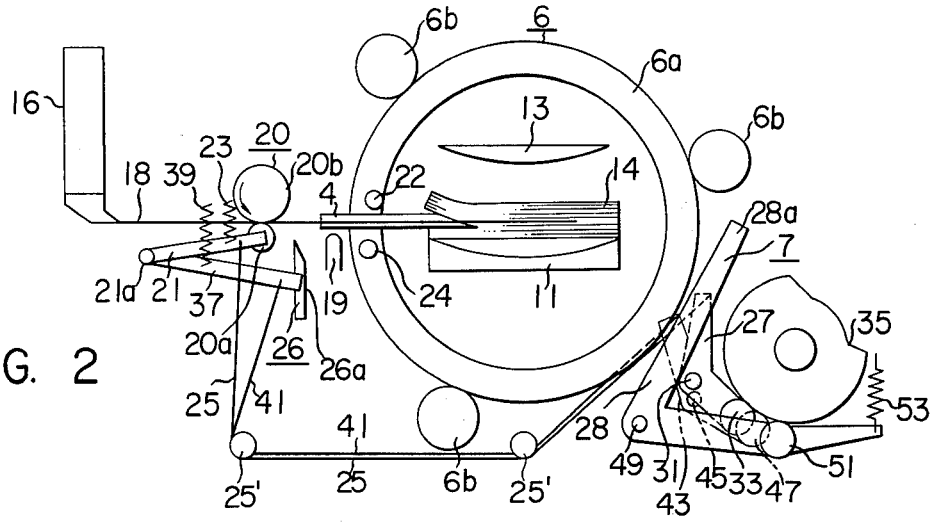
FIG. 2
FIG. 3
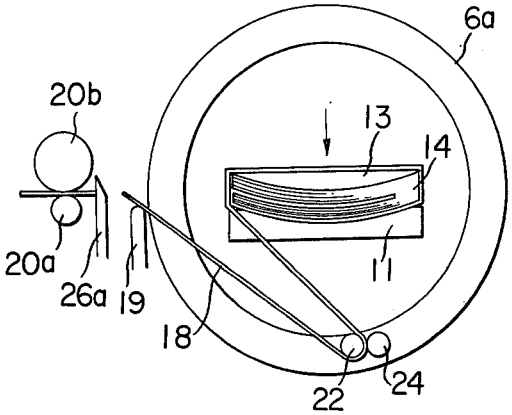
FIG. 4
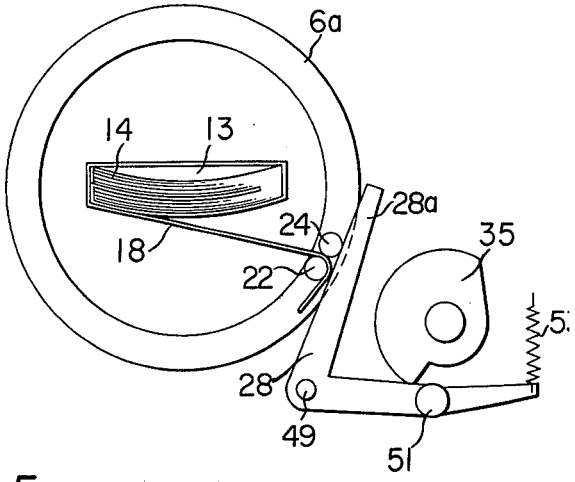
FIG. 5
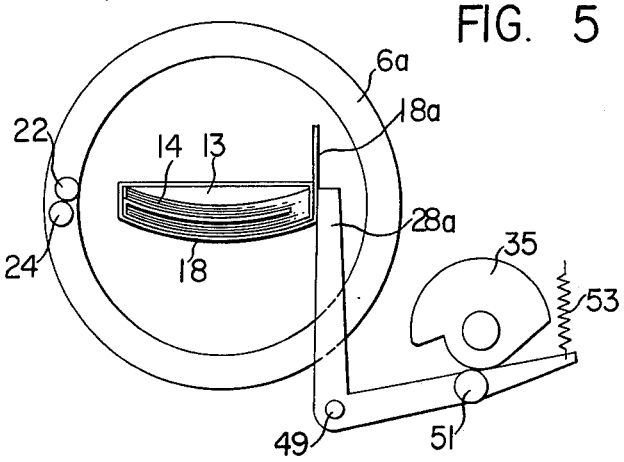
FIG. 6
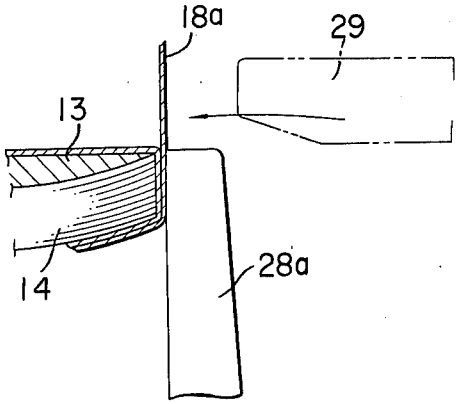

BINDING TAPE DEALING APPARATUS FOR PAPER BUNDLE BINDING APPARATUS

BACKGROUND OF THE INVENTION

The present invention relates in general to a binder apparatus for binding a bundle of stacked papers such as paper money and in particular to an apparatus for dispensing and dealing a binder tape which is wound around the bundle of the stacked papers to be bound.

In some applications, it is known that a bundle of many sheets of paper such as paper money is required to be bound by winding a binder tape therearound. In such case, a forward or leading end of the binding tape as fed from a supply reel is first inserted into the stacked papers. When the tape has been wound around the paper stack in a desired number of turns, the tape is cut and the cut end portion of the tape is bonded to the other tape portion wound around the paper stack in a superposed position.

In the field of the paper bundle binding, as described above, there exists on increasing demand for an apparatus which is capable of automatically dispensing and dealing the binding tape to be wound around a bundle or stack of paper sheets such as paper money, for example, to thereby reduce the required manual labor. Such apparatus should operate with a high efficiency under an appropriate timing control. Heretofore, there have been proposed many automatic binder tape dispensing and dealing devices for the paper bundle binding operation. However, these prior art devices still must be improved in many respects.

SUMMARY OF THE INVENTION

Accordingly, an object of the present invention is to provide a novel and improved apparatus for dispensing and dealing a bindling tape for the operation for binding a bundle of stacked paper sheets of a given thickness with the tape, which apparatus is capable of operating automatically in any of the phases of operation under a proper timing control, to thereby enhance the efficiency of the binding operation with an improved yield.

Another object of the invention is to provide a binding tape dispensing and dealing apparatus of the above type which can be constructed inexpensively in a rigid and simplified structure and operated with a high reliability.

With the above objects in view, there is proposed according to an aspect of the invention an apparatus for dispensing and dealing a binding tape for an apparatus for binding a bundle of stacked paper by the binding tape, which apparatus comprises an annular or ring-like rotatable flyer body provided with guide rollers for holding therebetween the binding tape and adapted to be revolved about a center thereof at which a stack of paper sheets to be bound is disposed, to thereby wind the binding tape around the paper stack as the ring-like flyer is revolved, a cutter for cutting the binding tape in a predetermined length, a pressing lever for pressing a portion of the binding tape adjacent to the cut end thereof against a lateral side of the paper stack, a first spring and cam for controlling the cutting operation of the cutter, and another spring and cam for controlling the movements of the pressing lever relative to the paper stack.

BRIEF DESCRIPTION OF THE DRAWINGS

The invention will become more readily apparent from the following description of a preferred embodiment thereof shown, by way of example, only, in the accompanying drawings, in which:

FIG. 2 is an elevational view illustrating the operation of the binding tape dispensing and dealing apparatus according to the invention;

FIG. 3 is a schematic elevational view showing the state of a ring-like flyer at a position at which the binding tape is cut;

FIG. 4 is a schematic elevational view showing a state in which guide pins mounted on the flyer ring are engaged by a tape pressing lever;

FIG. 5 is a schematic elevational view showing a state in which the outer end portion of the binding tape is pressed against a lateral side of a paper stack by means of a pressing lever; and FIG. 6 is a schematic elevational view showing a state in which the binding tape is bonded together.

DETAILED DESCRIPTION OF THE PREFFERED EMBODIMENT

Figure 1:
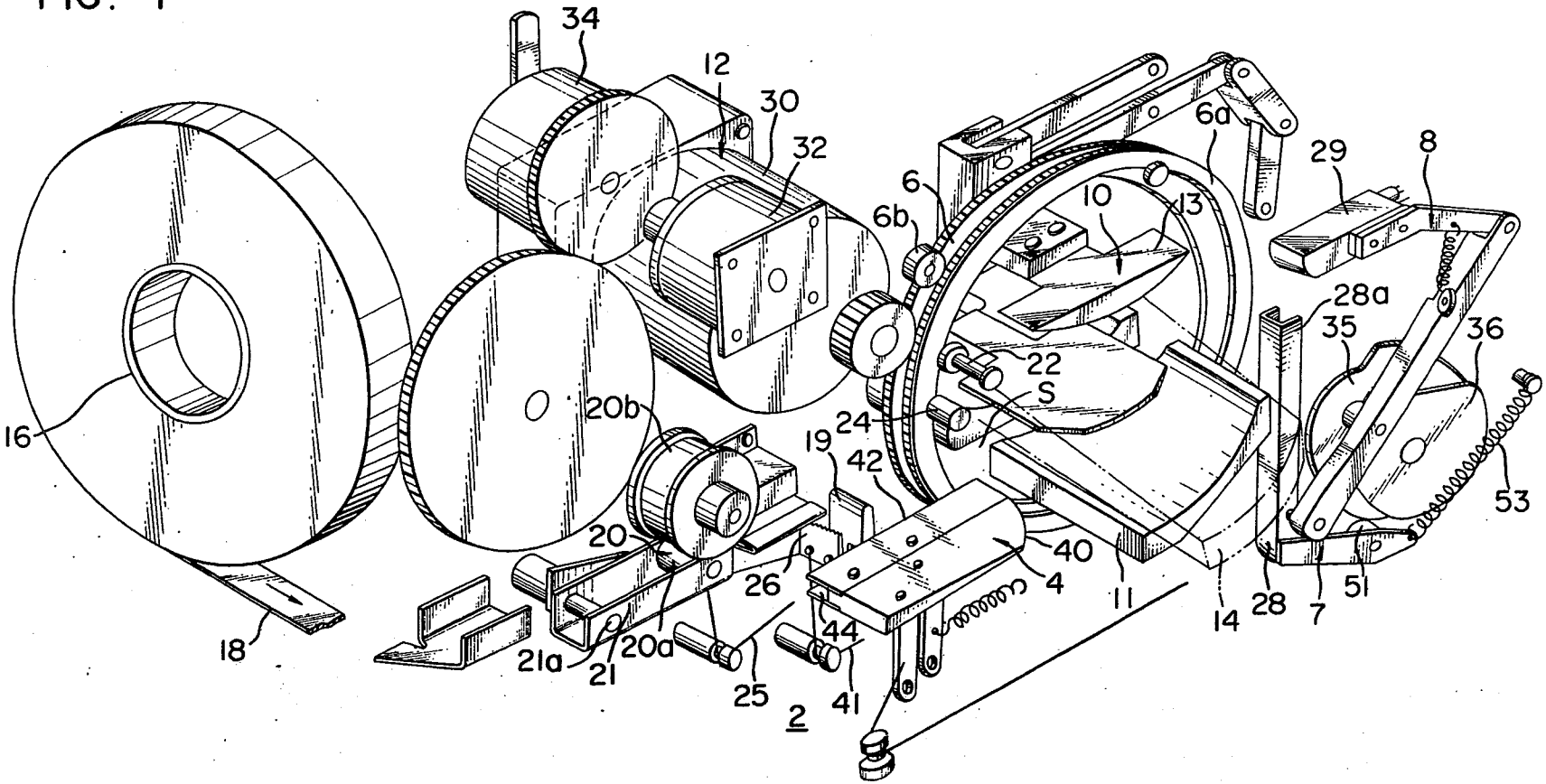
FIG. 1 is a partially exploded perspective view showing schematically an arrangement of a paper bundle binder apparatus which incorporates therein a binding tape dispensing and dealing apparatus according to an embodiment of the invention.

Now, the invention will be described with reference to FIG. 1 which shows an exemplary embodiment of the paper bundle binding apparatus constructed in accordance with the teachings of the present invention.

Referring to FIG. 1 which shows schematically a general arrangement of a paper bundle binding apparatus for binding a bundle of stacked papers such as paper money according to a preferred embodiment of the invention, the binding apparatus generally denoted by reference numeral 2 comprises a divider unit 4 for producing a gap in a loaded stack or bundle 14 of paper such as paper money, a flyer assembly 6 for winding a binder tape or band around the paper sheet bundle, a press means 7 for pressing together the cut binder tape, a sealing unit or assembly 8 for sealing the pressed end portion of the binder tape to the portion of the tape wound around the bundle of paper sheets, a clamping unit 10 for holding the paper bundle in a compressed state, a driving unit 12, a tape feeding or dispensing unit 20 and a tape cutting unit 26.

When a bundle 14 of stacked paper sheets such as paper money is to be bound with the aid of the binder apparatus 2 shown in FIG. 1, the divider unit 4 is first moved from a position shown in solid lines in FIG. 1 to a position in a path shown in broken lines along which the paper stack or bundle is fed, whereby the stack of papers is divided and a gap is formed in the paper stack 14, as the latter is fed to the divider unit 4. A heat sensitive binding tape or strip 18 stored as wound around a supply reel 16 in a form of roll is then drawn or dispensed. The leading end portion of the binder tape or band 18 is fed along a predetermined path by means of a pinch roller **20*a* and a feeding roller 20*b* which constitute parts of the tape feeding unit 20, and the band 18 is inserted into the gap formed in the stack of paper. When the binder band or tape 18 has thus been properly placed, the paper stack 14 is subjected to a clamping force through the clamping mechanism 10. Subsequently, the binder tape 18 is nipped between a pair of pins or rollers 22 and 24 which constitute parts of the binding band or tape winding unit 6 and which are rotatable relative to each other. When the band winding unit 6 is revolved together with the nipping pins 22 and 24 with the binder tape or band 18 being in the nipped state, the tape is then wound around the bundle of paper sheets 14 (refer to FIGS. 3 to 5). When a predetermined length of the binding tape has been wound around the paper bundle 14, a cutter means 26 which may be of any suitable conventional type is actuated upwardly to cut the tape 18, while the tape is prevented from becoming loosened by means of a pressing lever 28. Subsequently, the cut outer end portion of the tape or band 18 is then bonded to the wound portion of the tape 18 under the action of a bonding pad 29. The paper stack 14 thus having been completely bound can then be discharged from the binder apparatus. The above operations of the binder apparatus are effected by the driving unit or mechanism 12 comprising a motor 30, a braking means 32 and a clutch 34. Further, the timing required for the above outlined operations of the binder apparatus is conducted with the aid of cam means 36 which are also adapted to be driven by the driving means 12 and which are only partially shown in the drawings. Although the paper bundle or stack 14 is shown as being fed into the binder apparatus in a substantially horizontal position, it will be appreciated that the paper stack 14 may be inserted in a slightly or considerably inclined position so that the loading of the paper stack 14** may be facilitated. In such case, the associated individual units or mechanisms as described above will also be disposed in corresponding inclined positions.

In this connection, it should be mentioned that the divider or pick-up unit 4 described above may be the apparatus disclosed in copending U.S. patent application Ser. No. 789,274 of Yukio Ito et al., filed on Apr. 20, 1977 under the title of "APPARATUS FOR BINDING PAPER STACK," which corresponding to Japanese patent application Nos. 47208/1976 and 47212/1976, and which has been assigned to the same assignee as the present application. Additionally, the binding tape dispensing and winding apparatus 6 described above may be the apparatus disclosed in copending U.S. patent application Ser. No. 791,150, of Yukio Ito et al., filed on Apr. 26, 1977 under the title "TAPE WINDING ARRANGEMENT FOR PAPER BUNDLE BINDING APPARATUS," which corresponds to Japanese patent application No. 47210/1976, and which has been assigned to the same assignee as the present application. Besides the aforementioned clamping apparatus 10 may be the apparatus disclosed in copending U.S. patent application Ser. No. 789,280 of Yukio Ito et al., filed on Apr. 20, 1977 under the title of "APPARATUS FOR CLAMPING PAPER STACK FOR WINDING THE SAME," which corresponds to Japanese patent application No. 47211/1976, and which has been assigned to the same assignees as the present application. Accordingly, for any further information about these apparatus, reference should be made to the above described U.S. patent applications, if necessary.

The present invention is primarily directed to the arrangement for treating the binding tape 18 in the operation for automatically binding a bundle 4 of papers by the tape 18. This arrangement comprises the flyer unit 6, the tape feeding unit 20, the tape cutting unit 26 and the tape end pressing unit 7 as outlined hereinbefore. In the following description, these units or mechanism will be described in more detail.

The flyer apparatus 6 comprises a ring-like main body **6*a* in which there are disposed a receiving base 11 as well as a pressing or clamping pade plate 13. The ring-like flyer body 6*a* is provided with three supporting rolls 6*b* disposed at the outer periphery of the body 6*a*, at positions substantially equally spaced from one another, as can be seen from FIG. 2. Disposed at one lateral side of the flyer body 6 are a pair of first and second stationary guide pins 22 and 24, respectively, which serve to hold the binding tape 18 therebetween and to guide the tape as will be described hereinafter. To this end, the second guide pin 24 is mounted so that it may be moved toward and away from the first guide pin 22**.

The tape feeding unit 20 comprises a feeding roller **20*b* and a pinch roller 20*a* positioned in opposition to each other with the tape feeding path extending therebetween. The pinch roller 20*a* is rotatably supported by a supporting lever member 21 having a channel-like cross-section at a free end thereof. The lever member 21 is rotatably mounted at the other end thereof on a shaft 21*a*. A spring 23 (FIG. 2) is connected to the lever member 21 so that the lever 21 is constantly urged toward a position in which the pinch roller 20*a* is caused to bear against the feeding roller 20*b*. Also connected to the supporting lever member 21 is a wire or cord 25 which is passed over guides 25' and is connected to one end of another lever member 27. The lever member 27 in turn is rotatably supported on a shaft 31 and has the other end provided with a cam follower 33 which is adapted to engage with a cam 35 (FIG. 2**).

The tape or band cutting assembly 26 has a cutter blade **26*a* (FIG. 29 which is disposed substantially perpendicularly to the path of the binding tape 18 and which is on a third supporting lever 37 (FIG. 2) at one end thereof, the lever 37 is turn being pivotally mounted on the shaft 21*a*. A spring 39 is connected to the supporting lever 37 and urges it in such a manner that the cutter blade 26*a* may be moved transversely across the path along which the binding tape or band 18 is fed. As in the case of the first lever 21, the lever 37 is linked to one end of a fourth lever 43 (show in broken lines in FIG. 2) by a wire or cord 41. The lever 43 is also pivotally mounted on a shaft 45 and has the other end provided with a cam follower 47 which is adapted to engage with the cam 35**.

The tape end pressing apparatus 7 which is located adjacent to but outside of the rotating path of the flyer unit 6 comprises an angle lever 28 of a channel-like cross-section which is rotatably supported on a shaft 49 and which has one end portion **28*a* extending in a direction substantially tangential to the circumference of the ring-like flyer body 6*a* over a length sufficient to contact with a side of the stacked papers 14. The lever 28 has adjacent the other end thereof a cam follower 51 which is adapted to engage with the cam 35. A spring 53 is connected to the lever 28 at one end thereof, as can be seen from FIGS. 1 and 2. When the cam follower 51 is disengaged from the cam 35, the end portion 28*a* of the lever 28 is moved toward the side portion of the stacked paper bundle 14 under the tension exerted by the spring 53**.

With the arrangement as above described, when a bundle of stacked papers such as paper money is to be bound by the binding band or tape 18, the second guide pin 24 is at first separated from the first guide pin 22 of the flyer unit 6, and the divider unit 4 is advanced so that a knife edge 40 thereof will extend through a space existing between the separated pins 22 and 24 and hence into the stack of papers 14, to thereby allow the leading end portion of the binding tape 18 to be inserted into the paper stack 14, in a gap therein produced by the inserted divider knife edge-like portion 40.

More particularly, the binding tape 18 is unwound from the tape supply reel 16 and fed through the feeding roller 206 and the pinch roller 20*a* as guided by a guide means 19 and hence through a groove defined between plates 42 and 44 provided at the rear lateral side of the divider mechanism 4 as viewed in FIG. 1, as a result of which the leading or forward end portion of the binding tape 18 is inserted into the paper stack 14. Subsequently, the pad plate 13 is moved downwardly, whereby the paper stack 14 resting on the receiving base 11 is placed under compression and the forward end portion of the binding band 18 as inserted is prevented from being accidentally withdrawn from the paper stack 14. Under these conditions, the flyer body 6*a* is rotated. Then, the binding tape 18 is wound around the paper bundle and the pressing pad plate 13. In this connection, it should be noted the receiving base 11 is formed with a slot S of a sufficiently large width to allow the passage of the binding tape 18 therethrough, so that it will never occur that the supporting base 11 is wound together by the tape or band 18, as will be seen from FIG. 1.

When the tape 18 has been wound around the paper bundle 14 and the pad plate 13 for a predetermined number of turns, then the tape cutting operation is commenced, as is shown in FIG. 3. The cutting operation of the cutter blade 26*a* is controlled by the lever 43 through the cord 41 connecting lever 43 to the lever 37 which supports the cutter blade 26*a*. On the other hand, the movement of the lever 43 is controlled by the cam follower 47 adapted to cooperate with the cam 35. When the tape 18 has been cut, the pinch roller 20*a* is moved away from the binding tape 18, which results in the interruption of the tape feeding from the supply reel 16. It will be appreciated that the movement of the pinch roller 20*a* is controlled by the lever 27 through the connecting cord or wire 25, which lever 27 in turn is controlled by the cam 35 through the cam follower 33. The flyer body 6*a* continues, however, to be rotated.

When the flyer body 6*a* has been rotated to the position shown in FIG. 4, the cam follower 51 is disengaged from the cam 35. Consequently, the end portion 28*a* of the lever 28 is moved toward the flyer body 6*a* under the influence of the spring 53. This movement of the lever 28 is stopped by the paired guide pins 22 and 24 mounted on the flyer body 6*a* (FIG. 4). Further rotation of the flyer body 6*a* will cause the end portion of the tape 18 to be released from the paired guide pins 22 and 24 (FIG. 5). At the same time the lever 28 is also released from the engagement with the guide pins 22 and 24, whereby the lever end portion 28*a* will bear against the side portion of the bound paper bundle 14. Thus, the tape end portion 18*a* is pressed against the side portion of the paper bundle 14 and is folded upwardly by the contacting pressure of the lever end portion 28*a* as is shown in FIG. 5. When this state has been attained, the rotation of the ring-like flyer body 6*a* is stopped.

At the final stage of operation, the folding pad 29 is moved onto the pad plate 13 in such a manner as shown in FIG. 6. It will be noted that this movement causes the tape 18 to be folded over the pressing pad 13. After the bonding of the tape 18 which may be thermally effected by a suitable heating means which may be provided in the lever end portion 28*a* and/or the pad 29, the pad plate 13 is withdrawn from the paper bundle 14 which has now been completely bound.

As will be appreciated from the foregoing description, a bundle of papers can be bound by a tape in an automatic manner in the apparatus according to the invention. Further, since various operations of various components as well as mechanisms are controlled by cams mounted on a common shaft, it is easily possible to impart a proper timing to the operations of the various means by correspondingly contouring the cams or setting proper positional and/or operational relationships between the cams and the members controlled thereby. When a heat sensitive tape adapted to be a thermally bonded is employed, the tape portion pressed against the side portion of the bound paper bundle (FIG. 6) can be also thermally bonded by a heater provided in the lever end portion 28*a*, whereby the binding of the paper bundle can be reinforced. In this connection, it will be easily appreciated that a pressure sensitive binding tape may be alternatively employed, thus avoiding the necessity of providing the heating means.

The invention provides a tape treating apparatus for a paper bundle binding apparatus which is capable of automatically binding a bundle of stacked papers by properly controlled and timed operations with a relatively simple and inexpensive construction.

Although a single preferred embodiment has been described above, it will be readily understood by those skilled in the art that various rearrangements of parts and modifications thereof may be accomplished without departing from the spirit and scope of the invention as defined in the appended claims.

What we claim is:

1. An apparatus for dispensing a binding tape and for wrapping the binder tape around a bundle of stacked paper sheets, thereby binding the bundle, said apparatus comprising:

stationary supporting means for supporting a bundle of paper sheets at a binding position, said supporting means including a pair of supporting members separated by a gap, such that a bundle of paper sheets rests on said pair of supporting members and spans said gap;

divider means including an integral knife edge portion for dividing the bundle of paper sheets into two separate layers, said divider means being movable between an inoperative position spaced from the bundle of paper sheets supported on said supportinng means and an operative position whereat said knife edge portion extends into the bundle of paper sheets, said divider means having integrally and fixedly attached thereto tape guide means;

tape feed means for feeding a binding tape along a tape feeding path to said tape guide means when said divider means is in said operative position thereof, and for feeding the leading end of said tape into the space between the two separate layers of the bundle of paper sheets, whereafter said divider means moves to said inoperative position thereof, such that said leading end of said tape is inserted within the bundle of paper sheets;

a rotatable annular flyer body positioned to surround said stationary supporting means and the bundle of paper sheets supported thereon;

means, on said flyer body, for selectively grasping said tape after said leading end of said tape is inserted within said bundle of paper sheets, said grasping means comprising a first guide roller fixedly positioned on said flyer body and a second guide roller mounted to be selectively movable circumferentially of said flyer body between a first position toward said first guide roller to nip said tape between said first and second guide rollers and a second position spaced from said first guide roller, said divider and tape guide extending in their operative position between said guide rollers in their second position to guide said tape between said rollers;

means for rotating said flyer body, while said tape is nipped between said first and second guide rollers, and for thereby wrapping said tape around the bundle of paper sheets through said gap in said supporting means a predetermined number of times;

cutter means for cutting said tape at a position between said tape feed means and said flyer body;

first spring and cam means for causing said cutter means to cut said tape after said tape has been wrapped said predetermined number of times around the bundle of paper sheets, after which time said second guide roller moves to said second position thereof;

pivotally mounted pressing lever means for pressing a portion of said tape adjacent the free cut end thereof against a lateral side of the bundle of paper sheets, to thereby prevent said tape from becoming loosened; and second spring and cam means for controlling pivotal movement of said pressing lever means.

2. An apparatus as claimed in claim 1, wherein said first and second spring and cam means include a single cam operable to control both said cutter means and said pressing lever means.

3. An apparatus as claimed in claim 2, wherein said first spring and cam means comprises a spring constantly urging said cutter means in a direction perpendicular to said tape feeding path.

4. An apparatus as claimed in claim 1, wherein said second guide roller remains in said first position thereof a predetermined time after said cutter means cuts said tape.

5. An apparatus as claimed in claim 1, wherein said free cut end portion of said tape is caused to extend from the bound bundle of paper sheets, and further comprising sealing pad means for bending said free cut end portion of said tape and causing said free end tape portion to contact and be sealed against that portion of said tape which is wound around the bundle of paper sheets.

* * * * *